United States Patent [19]

Harshberger

[11] 4,083,102

[45] Apr. 11, 1978

[54] VIBRATORY RAZOR WITH ADJUSTABLE GUARDS

[76] Inventor: Russell P. Harshberger, P.O. Box 601, Pasadena, Calif. 91102

[21] Appl. No.: 749,377

[22] Filed: Dec. 10, 1976

[51] Int. Cl.[2] ..... B26B 21/38

[52] U.S. Cl. ..... 30/45; 30/74.1; 30/77

[58] Field of Search ..... 30/44, 45, 46, 74.1, 30/77, 81, 83

[56] References Cited

U.S. PATENT DOCUMENTS

| | | | |
|---|---|---|---|
| 2,578,801 | 12/1951 | Harshberger | 30/44 X |
| 2,609,602 | 9/1952 | Harshberger | 30/45 |
| 3,636,627 | 1/1972 | Tiffen | 30/45 |

FOREIGN PATENT DOCUMENTS

| | | | |
|---|---|---|---|
| 665,085 | 9/1938 | Germany | 30/77 |
| 510,560 | 8/1939 | United Kingdom | 30/83 |

*Primary Examiner*—Gary L. Smith
*Attorney, Agent, or Firm*—William W. Haefliger

[57] ABSTRACT

A battery operated razor comprises:

(a) a handle in the form of a stem, a battery in the stem, a battery operated motor in the stem, and means displaceable by the motor in the stem in response to battery energization of the motor to produce vibration, and (b) a blade receiving head assembly removably attached to the stem, the assembly including a blade guard yieldably supported for limited displacement relative to the blade and stem, whereby the blade is vibrated relative to the guard when the guard is urged against a user's skin and the motor is energized.

15 Claims, 8 Drawing Figures

VIBRATORY RAZOR WITH ADJUSTABLE GUARDS

BACKGROUND OF THE INVENTION

This invention relates generally to battery powered razors, and more particularly concerns a very simple motorized razor wherein the battery and motor are located within a hand-held stem, and the blade may comprise a conventional single or double edged safety razor blade.

Many forms of motorized or powered shavers or razors have been proposed in the past; however, none of which I am aware provide the unusual advantages in construction, mode of operation and results as afforded by the present invention. Among these are provision for use of a conventional single or double edged safety razor blade; location of the battery energized vibration creating structure within a hand-held stem; a spring-supported or floating blade guard relative to which the stem and blade are vibrated; removable assembly of all parts to facilitate ease of disassembly for cleaning; and extreme simplicity. As will be seen, the invention enables elimination of structure to support a blade for vibration relative to structure which carries the blade.

SUMMARY OF THE INVENTION

It is a basic object of the invention to provide a hand-held razor or shaver providing combinations of advantages and features as outlined above, and as are further described herein. Basically, the device comprises (a) a handle in the form of a stem, a battery in the stem, a battery operated motor in the stem, and means displaceable by the motor in the stem in response to battery energization of the motor to produce vibration, and (b) a blade receiving head assembly removably attached to the stem, the assembly including a blade guard yieldably supported for limited displacement relative to the blade and stem, whereby the blade is vibrated relative to the guard when the guard is urged against a user's skin and the motor is energized.

As will be seen, the head assembly may include a bed plate adapted to receive a blade thereon, and a cap extending over the bed plate to hold the blade in position thereon, for vibration in conjunction with the plate and cap. Further, spring structure carries the blade guard for limited floating displacement, and in one form of the invention novel adjustable means is provided in association with the spring structure to adjustably shift the position of the guard relative to the blade and stem, both laterally and toward and away from the blade edges, for control of "bite" of the blade, i.e. closeness of shave, as well as allowing vibration of the blade and stem relative to the skin engaging blade guard.

These and other objects and advantages of the invention, as well as the details of an illustrative embodiment, will be more fully understood from the following description and drawings, in which:

DRAWING DESCRIPTION

DETAILED DESCRIPTION

Figure 1:
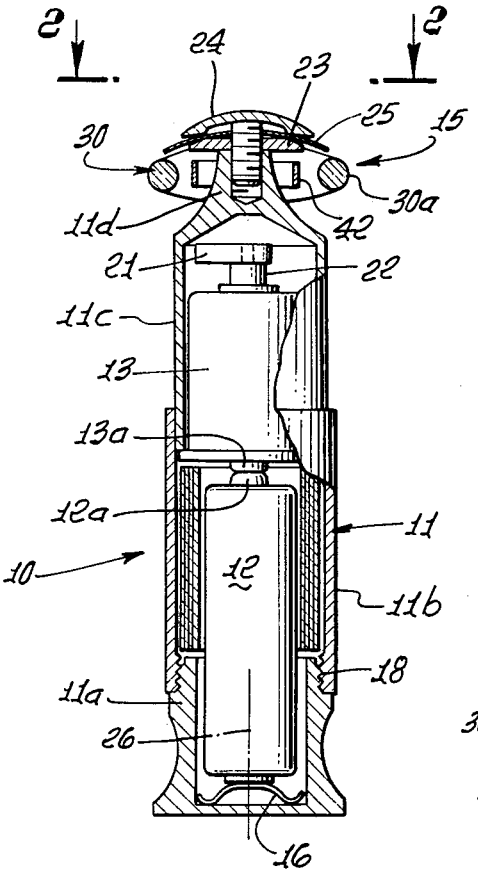
FIG. 1 is a side elevation, in section, showing a razor incorporating the invention.
Figure 2:
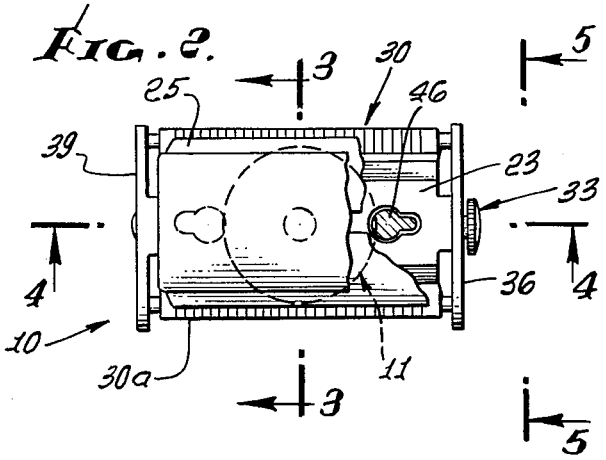
FIG. 2 is a plan view taken on lines 2—2 of FIG. 1.

FIGS. 1–6 illustrate a battery operated razor 10 that includes a handle in the form of a tubular stem 11. The latter contains a dry cell battery 12 and a small motor 13, these components having terminals **12*a* and 13*a*. When an end cap portion 11*a* of the stem is tightened toward the head assembly 15, the terminals are forcibly interengaged, as via pressure exertion by spring 16 and the battery, to energize the motor. In this regard, the end cap may have threaded connection at 18 with the stem section 11*b* to facilitate such tightening. Cap 11*a*** defines an electrical ground.

Figure 3:
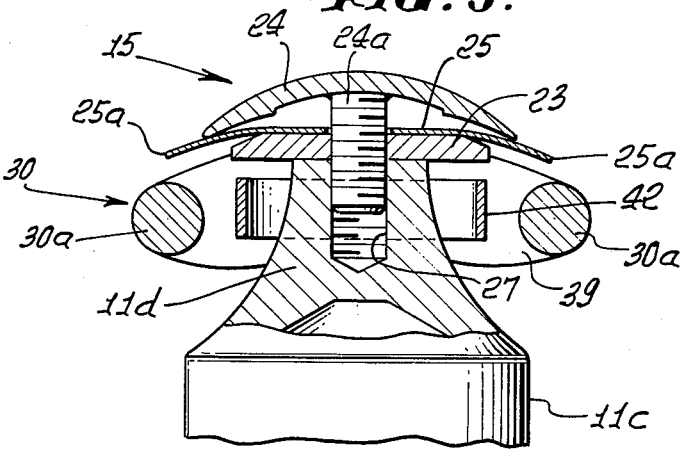
FIG. 3 is an enlarged section taken on lines 3—3 of FIG. 2.
Figure 4:
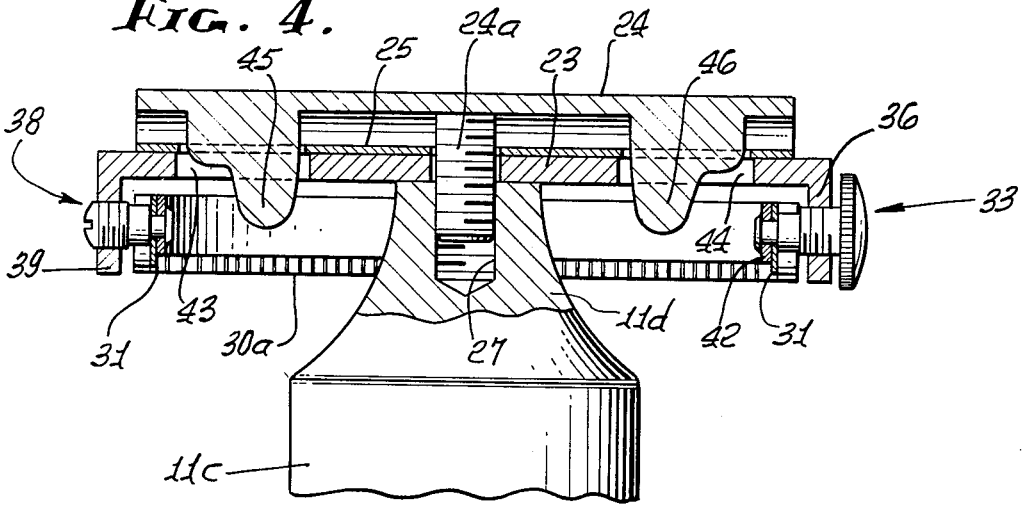
FIG. 4 is an enlarged section taken on lines 4—4 of FIG. 3.
Figure 5:
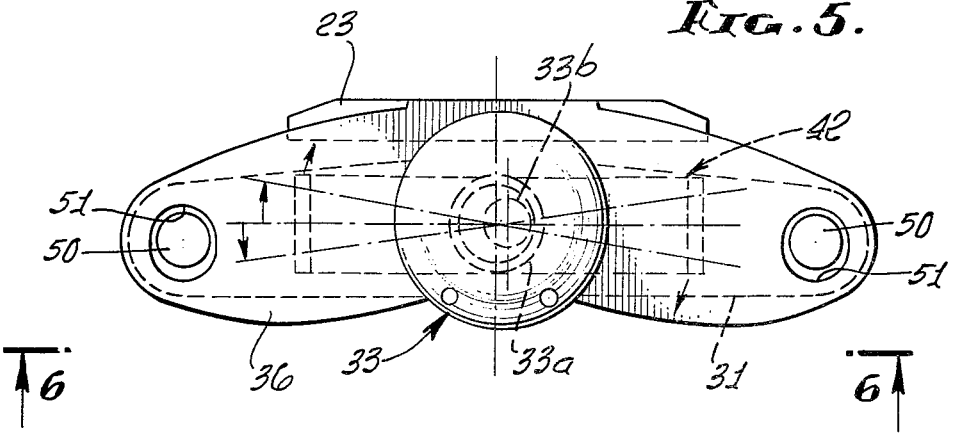
FIG. 5 is an enlarged side elevation of the FIG. 1 razor head.
Figure 6:
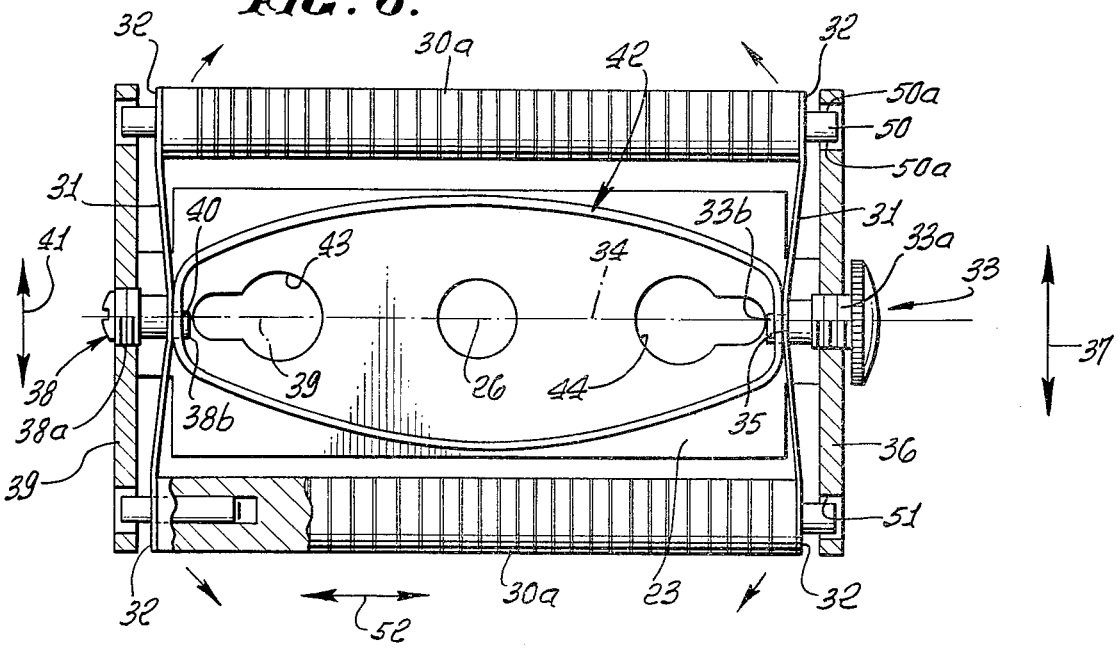
FIG. 6 is a bottom view taken on lines 6—6 of FIG. 5.

The motor, when energized, produces vibration transmitted to certain components of the head assembly and the blade. For this purpose, means is provided to be displaced by the energized motor to produce such vibration. Such means may advantageously include an eccentric mass 21 rotatable by the motor rotor 22, in the stem, that mass being located between the motor and head assembly and proximate that end of the stem to which the head assembly is attached. As a result, the stem section **11*c* surrounding the motor is vibrated in directions normal to the stem axis, and such vibration is transmitted via the stem tapered end portion 11*d* to a bed plate 23 and a cap 24 extending over the bed plate to hold a blade 25 in position on that plate, as shown. The cap has a threaded shank 24*a* received and tightened in an interiorly threaded axial bore 27 in the stem end portion 11*d*, and when the stem is rotatably tightened toward the cap, the blade is clamped between the bed plate and cap, as seen in FIG. 3. Plate 23 extends in and defines a plane normal to the axis 26 of the stem or handle. Mass 21 rotates about axis 26**.

In accordance with an important aspect of the invention, the head assembly 15 includes spring structure carrying a blade guard for limited displacement, together with adjustable means carrying such spring structure to adjustably shift the position of the guard relative to the blade and stem. As shown, the illustrated guard 30 includes two longitudinal guard members **30*a* which are laterally spaced apart to extend adjacent blade cutting edges 25*a*, i.e. in underlying relation thereto, the razor being of safety, double edge blade type; however, the invention is also applicable to razors incorporating single edge blades. Spring structure carrying the guard 30 includes two laterally extending flat springs 31 attached to the guard members at longitudinally spaced locations 32**.

The adjustable means carrying such spring structure, as referred to, may advantageously include a first manually rotatable element, as at 33, having an axis of rotation 34, the element 33 connected to one flat spring 31 at 35 in eccentric relation to the axis 34. In this regard, adjustment element 33 may have a shank **33*a* in threaded engagement with a threaded bore in a laterally extending frame member 36; further, an eccentric projection 33*b* on element 33 may interfit the flat spring 31, as via a suitable hole therein, to define the connection at 35. It is clear that rotation of element 33 variably displaces the flat spring in directions toward or away from the blade edges at one end of the blade, and in either of the directions indicated by arrows 37 in FIG. 6. Similarly, the adjustable means includes a second manually rotatable (as by a screw driver) element 38 having an axis of rotation 39 which is coaxial with the axis 34 of rotation of element 33. Element 38 is connected at 40 to the other flat spring 31 in eccentric relation to the axis 34. Note element shank 38***a* in threaded engagement with a threaded bore in laterally extending frame member 39; further, eccentric projection 38*b* on element 38 may interfit the second flat spring 31, as via a suitable hole therein, to define the connection 40. Rotation of element 38 variably displaces the second flat spring 31 in directions toward or away from the blade edges at the opposite end of the blade, and in directions indicated by arrows 41 in FIG. 6. Accordingly, complete adjustment of the blade in multiple directions is simply achieved, to suit best shaving conditions for a particular shaver.

A longitudinally elongated, hoop-shaped part 42 is attached to the projections 33*b* and 38*b*, as shown. As the latter are rotated, one or the other of the legs of part 42 engages the underside of plate 23, limiting adjustment rotation of the projections. Note openings 43 and 44 in the bed plate to receive blade positioning lugs 45 and 46 depending from the cap.

It will be noted that the frame members and guard members define stops to limit displacement of the guard relative to the frame and stem. As shown, the stops are defined by spaced tongue and groove shoulders at longitudinally opposite ends of the guard members, and laterally opposite ends of the frame members. See for example the laterally spaced shoulders 50*a* on the pins 50 on the guard members projecting with substantial clearance into the bores 51 defined by the frame members, at four such locations. Accordingly, the guard may be adjusted (as by elements 33 and 38) to limited extent about axis 26, relative to the frame, and vibration of the frame and blade relative to the guard, and normal to axis 26, is enabled. Vibration directions are designated by arrows 37, 41 and 52.

Figure 7:
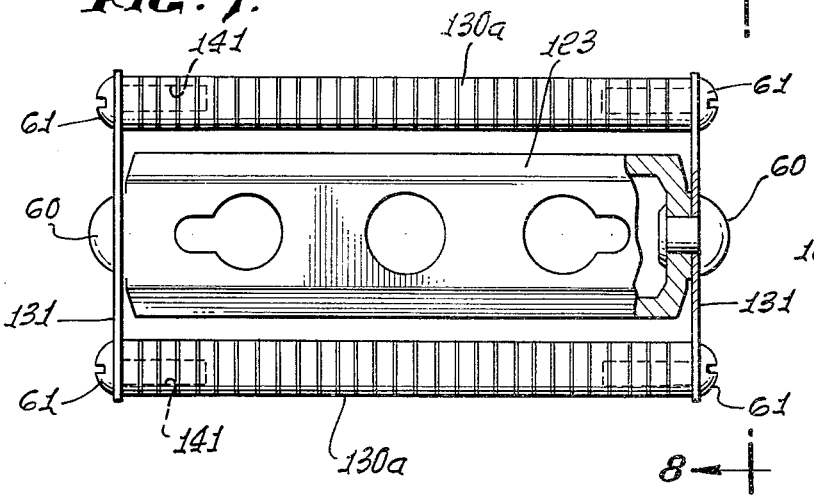
FIG. 7 is a view like FIG. 6 showing a modification.
Figure 8:
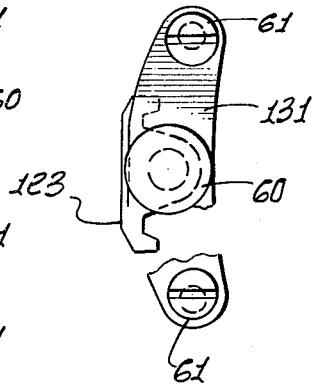
FIG. 8 is an end elevation taken on lines 8—8 of FIG. 7.

The modification shown in FIGS. 7 and 8 is like that described above, corresponding parts in FIGS. 7 and 8 bearing the number 1 ahead of the remaining two numbers (which are the same as the numbers in FIGS. 1–6). However, the construction is simplified in that the frame members 36 and 39 and adjustment elements 33 and 38 are eliminated. The flat springs are attached to the bed plate 123, as by rivets 60, at longitudinally spaced locations, and the lateral ends of the springs 131 are adjustably fastened at 61 to opposite longitudinal ends of the guard members 130*a*. The fasteners 61 may have first shank portions rotatable in openings in the flat springs 131, and second shank portions which are received in threaded openings 141 in the guard members. The first and second shank portions may be slightly eccentric (say about 0.010 inch), so that turning of the fasteners effects slight adjustment of the blade guards relative to the blade.

I claim:

1. In a battery operated razor, the combination comprising (a) a handle in the form of a stem, a battery in the stem, a battery operated motor in the stem, and means displaceable by the motor in the stem in response to battery energization of the motor to produce vibration, and (b) a blade receiving head assembly removably attached to the stem, the assembly including a blade guard yieldably supported for limited displacement relative to the blade and stem, the head assembly including a longitudinally elongated bed plate adapted to receive the blade, the guard extending longitudinally in laterally offset relation to longitudinally elongated edge means defined by the bed plate, there being flat springs extending laterally between the bed plate and longitudinally spaced opposite ends of the guard to directly and floatably connect the guard to the bed plate whereby the blade is vibrated relative to the guard when the guard is urged against a user's skin and the motor is energized, there being adjustable means operatively attached to the flat springs to adjustably shift the position of the guard relative to the bed plate.

2. The combination of claim 1 including a cap extending over the bed plate to hold the blade in position thereon, the bed plate and cap carried by an end portion of the stem.

3. The combination of claim 1 wherein said guard includes two longitudinal guard members which are laterally spaced apart to extend adjacent blade cutting edges, said flat springs attached to the guard members at longitudinally spaced end locations on the guard members and laterally spaced locations on the flat springs.

4. The combination of claim 1 wherein said means to vibrate the stem includes an eccentric mass rotatable by the motor in the stem about an axis defined by the stem.

5. The combination of claim 4 wherein said mass is located between the motor and head assembly and proximate that end of the stem to which the head assembly is attached.

6. The combination of claim 2 including said blade clamped between the bed plate and cap.

7. The combination of claim 3 wherein said adjustable means includes fasteners attaching the flat springs to the guard members at said locations, to provide eccentric connections whereby rotation of the fasteners shifts the guard members relative to the flat springs.

8. In a battery operated razor, the combination comprising (a) a handle in the form of a stem, a battery in the stem, a battery operated motor in the stem, and means displaceable by the motor in the stem in response to battery energization of the motor to produce vibration, and (b) a blade receiving head assembly removably attached to the stem, the assembly including a blade guard yieldably supported for limited displacement relative to the blade and stem, whereby the blade is vibrated relative to the guard when the guard is urged against a user's skin and the motor is energized, (c) the head assembly including spring structure carrying the blade guard for said limited displacement, and adjustable means carrying said spring structure to adjustably shift the position of the guard relative to the blade and stem.

9. The combination of claim 8 wherein said guard includes two longitudinal guard members which are laterally spaced apart to extend adjacent blade cutting edges, said spring structure includes two laterally extending flat springs attached to the guard members at longitudinally spaced locations, and said adjustable means includes a first manually rotatable element having an axis of rotation, said element connected to one of said flat springs in eccentric relation to said element axis of rotation.

10. The combination of claim 9 wherein said adjustable means includes a second manually rotatable element having an axis of rotation, said second element connected to the other of said flat springs in eccentric relation to said second element axis of rotation.

11. The combination of claim 10 wherein said two elements are longitudinally spaced part, said head assembly including two longitudinally spaced frame members, said two elements having threaded interconnection with the respective frame members.

12. The combination of claim 11 wherein said frame members extend laterally, and said frame members and guard members defining stops to limit said relative displacement of the guard.

13. The combination of claim 12 wherein said stops are defined by spaced tongue and groove shoulders at longitudinally opposite ends of the guard members and laterally opposite ends of the frame members.

14. The combination of claim 10 including a part attached to said elements and extending longitudinally therebetween, said part being rotatable to engage a bed plate defined by the head assembly, thereby to limit adjustment rotation of said elements.

15. In a battery operated razor, the combination comprising (a) a handle in the form of a stem, a battery in the stem, a battery operated motor in the stem, and means displaceable by the motor in the stem in response to battery energization of the motor to produce vibration, and (b) a blade receiving head assembly removably attached to the stem, the assembly including a blade guard yieldably supported for limited displacement relative to the blade and stem, whereby the blade is vibrated relative to the guard when the guard is urged against a user's skin and the motor is energized, (c) the head assembly including spring structure carrying the blade guard for said limited displacement, and adjustable means attached to said spring structure to adjustably shift the position of the guard relative to the blade and stem.

* * * * *